United States Patent [19]

Kaiser

[11] 4,169,301

[45] Oct. 2, 1979

[54] GILLING OR STRETCHING APPARATUS

[75] Inventor: Hans Kaiser, Waldshut, Fed. Rep. of Germany

[73] Assignee: Hanseatischer Maschinenbau G.m.b.H., Hamburg, Fed. Rep. of Germany

[21] Appl. No.: 857,459

[22] Filed: Dec. 5, 1977

[30] Foreign Application Priority Data

Dec. 4, 1976 [DE] Fed. Rep. of Germany ..... 2655079

[51] Int. Cl.[2] ..... D01H 5/04

[52] U.S. Cl. ..... 19/129 R

[58] Field of Search ..... 19/129 R, 129 A, 127

[56] References Cited

FOREIGN PATENT DOCUMENTS

| | | | |
|---|---|---|---|
| 528560 | 7/1931 | Fed. Rep. of Germany | 19/129 R |
| 1081766 | 8/1967 | United Kingdom | 19/129 R |
| 520422 | 10/1976 | U.S.S.R. | 19/129 R |

*Primary Examiner*—Dorsey Newton

*Attorney, Agent, or Firm*—Edward F. Levy

[57] ABSTRACT

In gilling or stretching apparatus wherein a plurality of pin bars are driven and guided in a circuitous path including a stretching run and a return run, with threaded spindles engaging the pin bars along said runs, means are provided to retard the speed of movement of the pin bars before they engage the drive spindles so as to decrease noise in the operating apparatus and reduce wear of the pin bars and spindles. Such retarding means comprises cushioning wheels disposed at the entry end of the stretching run and cushioning rollers disposed at the exit end of the stretching run. The cushioning wheels and rollers have cushioning surfaces arranged to be engaged by the moving pin bars at an acute angle to the tangent to the surface at the point of engagement. Means are provided to insure that the cushioning wheels and rollers rotate at a slower speed than the speed of the travelling pin bars.

12 Claims, 6 Drawing Figures

GILLING OR STRETCHING APPARATUS

Figure 1:
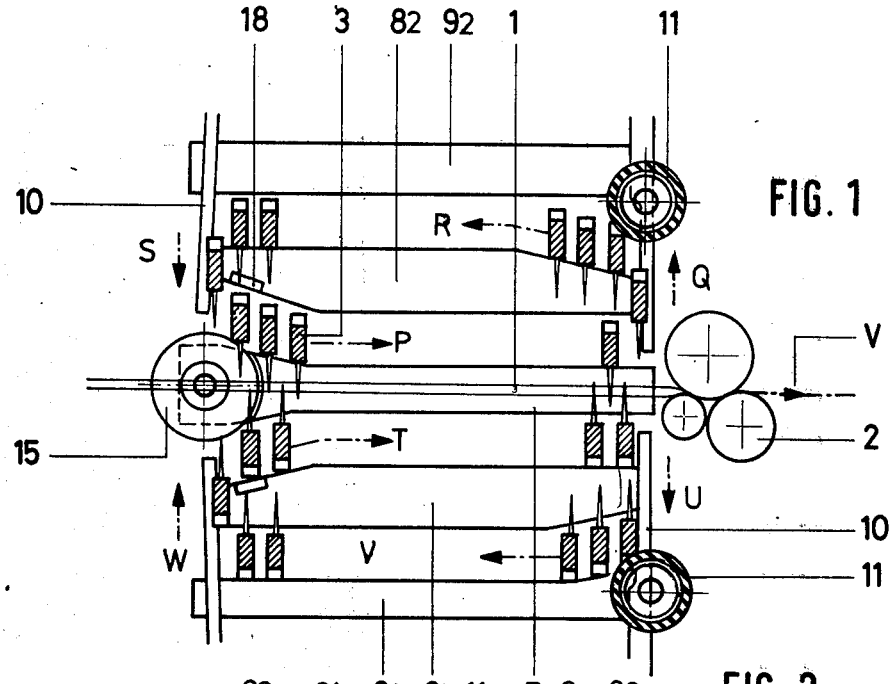

The present invention relates to gilling or stretching apparatus, such as needle stretchers, equipped with means for engaging and retarding pin bars.

A stretching apparatus having guide rails on which are disposed clamping members of shock absorbers has been disclosed in German Utility Pat. No. 1713711, wherein the guide rails have impact and rebound points which are equipped with elastic inlays, predominantly of rubber-elastic materials. This renders possible a reduction in wear of pin bar guides and also a reduction in the noise level when the pin bars contact the guide rails. The wear of the inlays within relatively short times renders such an apparatus of very limited use for high output rates, in spite of the ease with which the damping members could be replaced.

In order to reduce the wear of the pin bars and damping members, a screw operated stretching apparatus shown in DT-OS No. 1685565 has been proposed, and which possesses bridge like shock absorbers of a hard polyurethane elastomer disposed at the point of impact of the pin bars. These shock absorbers enable a considerable reduction in the wear of the pin bars to be achieved. In spite of the damping capability of the elastomer, however, because of the high hardness of the shock absorbers only a relatively small proportion of the impact energy is dissipated by internal friction, while the greater part is felt as spring-back resilience on the pin bars, and consequently it is not possible to reduce the noise level to an acceptable value. These shock absorbers are completely unsuitable for arresting the pin bars as they are guided back into the stretching field at the entry to the stretching field.

The damping devices disclosed in DT-OS-No. 2220581, in the form of rubber tabs or gas-filled or liquid-filled cushions disposed in the path of the pins bars, are also not capable of absorbing or annihilating considerable proportions of the kinetic energy of the pin bars. These damping devices also do not solve the problem of damping the pin bars guided back at the entry point into the stretching field. A feature common to the proposed solutions disclosed in all three of aforementioned documents is that a considerable relative speed between the pin bars and the surfaces of the damping devices exists and the angles at which the pin bars approach the damping members are very frequently close to a right angle.

According to the present invention there is provided gilling or stretching apparatus comprising movable pin bars and at least one movable device, which is engageable by the pin bars to retard their motion and which is provided with a cushioning surface so disposed that the direction of motion of the pin bars at the point of engagement of the surface is at an acute angle to the tangent to the surface at the point of engagement.

Preferably the surface is arranged, in operation, to move at a lower speed than the pin bars before the pin bar strike the surface. Also preferably the or each movable device is a cylindrical body and the surface is constituted by the circumference thereof.

The apparatus can have an entry and an exit end, wherein each pin bar comprises a bar and a head at each end of the bar, cushioning wheels being disposed at the entry end to be engageable by the heads, and cushioning rollers being disposed at the exit end to be engageable by the bar. The cylindrical bodies can be provided with axially extending ridges defining shoulder-portions of the cushioning surface. Also the cylindrical bodies can be equipped externally and/or internally with energy-dissipating means, which can comprise a rubber or elastomer layer defining the or each cushioning surface. The energy-dissipating means can comprise a partial filling of lead shot disposed in a space defined within the or each cylindrical body.

Preferably the pin bars are arranged to be moved by threaded spindles. The apparatus can comprise upper and lower sets of pin bars arranged to move in respective closed loops, the upper set of pin bars being arranged to be moved by hammers upwardly at the exit end to engage a cushioning roller and downwardly at the entry end to engage cushioning wheels, and the lower set of pin bars being arranged to be moved by hammers downwardly at the exit end to engage a cushioning roller and upperwardly at the entry end to engage cushioning wheels.

Figure 2:
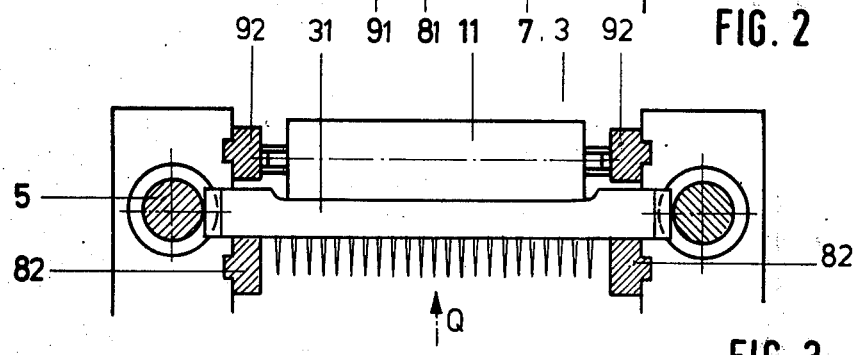
Figure 3:
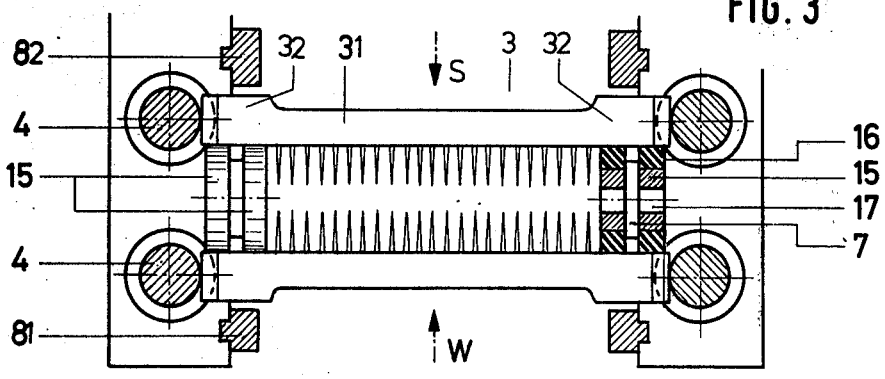
Figure 4:
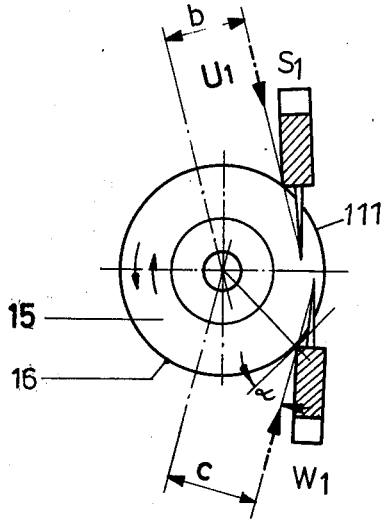
Figure 5:
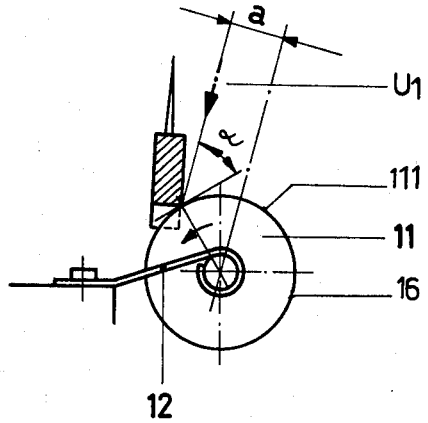
Figure 6:
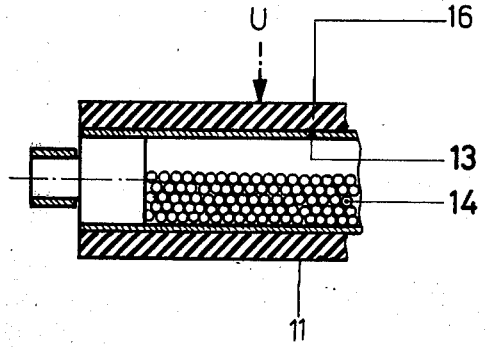

Embodiments of the present invention will now be more particularly described by way of example with reference to the accompanying drawings, in which:

FIG. 1 shows a longitudinal section through an embodiment of an apparatus according to the invention, FIG. 2 shows a partial view on the upper part of the exit end of the apparatus of FIG. 1, FIG. 3 shows a partial view on the entry end of the apparatus of FIG. 1, FIG. 4 shows a portion, to enlarged scale, of FIG. 1 at the entry point for the pin bars, FIG. 5 shows a portion, to enlarged scale, of FIG. 1 with a lower pin bar exiting, and FIG. 6 shows a longitudinal section through a cushioning roller which can be used in the apparatus of FIG. 1.

Referring to the accompanying drawings, reference 1 in FIG. 1 is a card sliver travelling through a stretching field, the drawing of this card sliver taking place in the direction of arrow V. At the end of the stretching field, there is a trio of drawing rolls 2. Along each side of the stretching field, central pin bar guides 7 are disposed. Beneath these central pin bar guides are lower pin bar guides 81, and beneath these lower bar guides are lowermost pin bar guides 91. Above the central pin bar guides 7 are disposed upper pin bar guides 82 and above these upper pin bar guides are uppermost pin bar guides 92. All the pin bar guides are fixed to the frame of the needle stretcher. Facing both ends of the lower and lowermost pin bar guides 81 and 91 and upper and uppermost pin bar guides 82 and 92, there are stops 10, capable of yielding against spring force. In the region of the stops 10, at the end of the stretching field, there are disposed one upper and one lower cushioning roller 11, while at the entry point to the stretching field at least two cushioning wheels 15 are disposed at the level of the central pin bar guides 7. Upper pin bars 3 are conveyed in the direction of the arrows, P, Q, R and S in a closed circulating path. Lower pin bars 3 are correspondingly conveyed in the direction of arrows T, U, V and W in a closed circulating path, each lower pin bar travelling at the same speed as each upper pin bar.

FIG. 2 shows return spindles 5, journalled in respective housings, and in the vicinity of each of these spindles there are a pair of upper pin bar guides 82 and uppermost pin bar guides 92. Between these upper and uppermost pin bar guides is a pin bar 3, situated in the returning position, and above the latter a cushioning roller 11, journalled to rotate freely.

FIG. 3 shows pairs of upper and lower advance spindles 4, journalled in each housing, and alongside each of these a pair of lower pin bar guides 81, upper pin bar guides 82 and central pin bar guides 7. Between each pair of advance spindles 4, there is shown one upper and one lower pin bar each comprising a bar 31 and a head 32 at each end of the par 31. Between the head of the upper pin bar and the lower pin bar at the same end of each bar there is a cushioning wheel 15 which is freely rotatable about pins 17 on each side of the central pin bar guides 7.

FIG. 4 shows a cushioning wheel 15 in lateral view together with one upper and one lower pin bar 3, while or just before these pin bars strike the face 16 of the cushioning wheel 15.

FIG. 5 shows a lower cushioning roller 11, mounted on a flexing spring 12, at the instant at which a pin bar 3 strikes its face 16.

The above described embodiment of a needle stretcher according the present invention operates as follows:

A card sliver 1 is drawn by means of a drawing cylinder 2 in the direction of arrow V through the stretching field formed by the upper and lower pin bars 3 and is thereby rendered parallel and stretched. The pin bars 3 are conveyed through the stretching field by the two pairs of advance spindles 4. In this action, the upper pin bars 3 slide along the upper sides of the central pin bar guides 7, and the lower pin bars 3 on the upper sides of the lower pin bar guides 81. When the upper pin bars 3 have reached the stops 10, they are thrown by hammers, not shown, of the advance spindles 4 in the direction of arrow Q and strike with their bar 31 on the face of the upper cushioning roller 11. They are then picked up by the screw threads of the upper return spindles 5 and are conveyed in the direction of arrow R sliding on the upper sides of the upper pin bar guides 82 as far as the stop 10, situated above the entry point. They are then accelerated there by the hammers, also not shown, of the return spindles in the direction of arrow S until they strike the faces of the cushioning wheels 15 and again are engaged by the screw threads of the upper advance spindles 4.

While being conveyed by the lower advance spindles 4 along the stretching field, the lower pin bars 3 slide on the upper sides of the lower pin bar guides 81, until, when they reach the stops 10, they are accelerated downwards by the hammers, not shown, of the lower advance spindles 4 in the the direction of arrow U and are then captured by the lower cushioning roll 11. They are then conveyed by the return spindles 5 in the direction of arrow V sliding on the upper sides of the lowermost pin bar guides 91 until they reach the stops 10 situated below the entry point. They are then accelerated upwards in the direction of arrow W by the hammers of the lower return spindles 5 and, after they have struck the cushioning wheels 15, are again guided into the screw threads of the lower advance spindles 4.

The arrangement of the cushioning rollers 11 and cushioning wheels 15 is such that the pin bars 3 are deflected from their initially vertical directions Q, S, U and W into paths of motion somewhat inclined relative to these, for example $S_1$, $U_1$, $W_1$, shown in FIGS. 4 and 5, then strike the cushioning rolls 11 or cushioning wheels 15 at distances a, b or c from the axis of the rolls or wheels which distances are smaller than the radii of these rolls or wheels, at an acute angle to the tangent at the contact point with the associated face 16 and impart a rotational acceleration to the cushioning rollers 11 or wheels 15. The pin bars 3 here give up the greater part of their energy of movement and undergo only a slight acceleration transversely to their direction of approach S1 or U1, so that they are not thrown into the screw threads of the return spindles 5 nor against the pin bar guides 81, 91 or 82, 92 respectively. Moreover, the reduction in wear of pin bars 3 and pin bar guides 7, 81, 82, 91 and 92 is accompanied by a lowering of the noise level, so that needle stretchers equipped in this manner can be operated with considerably higher speeds of the pin bars 3.

In order to bring the cushioning rollers 11 or wheels 15 each into a state suitable for accepting the largest part of the energy of movement of a pin bar 3 striking them anew, the layout of the cushioning wheels 15 may, for example, be so arranged that an upper and a lower pin bar 3 strike the faces 16 of the wheels at different times, so that the kinetic energy stored as inertia from one direction of rotation is cancelled out by the energy of movement transmitted from the next pin bar 3 by rotation in the opposite direction. It may be advantageous for the mounting of the cushioning rollers 11 to be constructed so as to yield, for example by means of a flexing spring 12.

It is possible to cancel out the energy stored as inertia about the rotational axis of a cushioning roller 11 by making the latter hollow and partially filling its hollow body 13 with a viscous or plastically deformable substance as shown in FIG. 6 which, when the cushioning roller revolves, converts the kinetic energy into heat and/or energy of position by internal friction or plastic deformation work. A suitable material for this purpose has proved to be lead shot 14. By an energy conversion of this type, it is possible for the endurance and life of the faces 16 of the cushioning rollers 11, cushioning wheels 15, heads 32 of the pin bars 3, and the pin bar guides 7, 81, 82, 91 and 92 to be increased several fold. Also noise caused by the pin bars banging against one another and against the guides can be reduced.

The cushioning rollers 11 can advantageously have a facing 16 of an elastic but not hard material, possessing high internal damping. Suitable materials for this purpose may be appropriately prepared types of natural or synthetic rubber or mixtures of these and elastomers such as those based upon polyurethane or plasticized PVC.

The angle $\alpha$ between the paths $S_1$ or $U_1$ of the pin bars 3 and the associated tangent to the facing 16 of a cushioning roller 11 or cushioning wheel 15 must in every case be less than 90°. Values of between 15° and 45° are especially advantageous.

The above described embodiments of the present invention enable a considerable portion of the kinetic energy of the pin bars to be mechanically annihilated while avoiding impact noises and at the same time reducing the wear of the pin bars, their guides and damping devices.

Also the striking velocity of the pin bars can be increased, their rebound can be reduced and their kinetic energy can be transferred without noise production to the desired extent to the cushioning surface which is loaded basically only tangentially by the forces which occur in the relative movement.

Further the movement energy can be transferred to the catching surface along the length of a pin bar, which results in a considerable reductiion in the loading of the pin bars in bending and local wear and also prevents build-up of bending oscillations. Moreover, the possibility is provided of engaging the pin bars as they enter the pin field in a manner which conserves them and dissipates energy and without the production of noise.

Also the energy transference even of smooth pin bars onto the catching rollers or wheels can be improved.

What we claim is:

1. Gilling or stretching apparatus comprising an upper set of individually movable pin bars and a lower set of individually movable pin bars, means for guiding said upper set of pin bars successively in a first circuitous path and means for guiding said lower set of pin bars successively in a second circuitous path, each of said circuitous paths comprising a closed loop having a linear stretching run, a linear return run in the opposite direction, and transverse runs connecting said stretching run and return at each end, said stretching run and return run each having an entry end and an exit end, the transverse run at the entry end of said first circuitous path being axially aligned with the traverse run at the entry end of said second circuitous path, drive means for driving said upper and lower sets of pin bars along said circuitous paths, with said upper and lower sets of pin bars travelling in the same direction in their respective stretching runs and travelling in opposite directions and toward each other in the transverse runs at their respective entry ends, a plurality of cushioning members rotatably mounted at the entry end of said stretching run of the first and second cylindrical paths and positioned to be engaged by each pin bar of said upper and lower sets as each of said pin bars travels from the exit end of said return run to the entry end of said stretching run, whereby to retard the motion of said pin bar, said cushioning members having a circumferential cushioning surface so disposed that the direction of travel of each pin bar at its point of engagement with said cushioning surface is at an acute angle to the tangent to said surface at said point of engagement, whereby to rotate said cushioning members, the upper set of pin bars engaging said cushioning members to rotate the latter in a first direction, and the lower set of pins bars engaging said cushioning members alternately to rotate the latter in a second opposite direction.

2. Apparatus according to claim 1 in which said cushioning members comprise a plurality of concentric wheels.

3. Apparatus according to claim 2 which also includes a cushioning roller for each of said upper and lower sets of pin bars, each cushioning roller being rotatably mounted at the entry end of the respective return run and positioned to be engaged by each pin bar of its respective set as the latter approaches the entry end of said return run, whereby to retard the motion of said pin bar, said cushioning roller having a circumferential cushioning surface so disposed that the direction of travel of each pin bar at its point of engagement with said cushioning surface is at an acute angle to the tangent to said surface at said point of engagement.

4. Apparatus according to claim 3 in which each of said pin bars comprises an elongated bar body and a head at each end of said bar body; said cushioning wheels being positioned for engagement by the heads of each pin bar, said cushioning rollers being positioned for engagement by the bar body of each pin bar at the entry end of said return run.

5. Apparatus according to claim 3 in which said drive means comprise advance threaded spindles for moving said pin bars along said stretching run, and return threaded spindles for moving said pin bars in the opposite direction along said return run.

6. Apparatus according to claim 5 in which said cushioning wheels are positioned to retard movement of each pin bar before said pin bar moves into operative engagement with said advance threaded spindles; and said cushioning rollers are positioned to retard movement of each pin bar before said pin bar moves into operative engagement with said return threaded spindles.

7. Apparatus according to claim 3 in which the upper set of pin bars are guided to move upwardly at the exit end of said stretching run and to engage the cushioning roller for the upper set of pin bars, and to move downwardly at the entry end of said stretching run and to engage said cushioning wheels, the lower set of pin bars being guided to move downwardly at the exit end of said stretching run and to engage the cushioning roller for the lower set of pin bars, and to move upwardly at the entry end of said stretching run and to engage said cushioning wheels.

8. Apparatus according to claim 1 in which said cushioning members are so arranged relative to said pin bars that said cushioning members rotate at a speed slower than the speed of travel of each pin bar before said pin bar strikes said cushioning surface.

9. Apparatus according to claim 1 in which said cushioning members are provided with energy dissipating means.

10. Apparatus according to claim 1 in which said acute angle is between 15° and 45°.

11. Apparatus according to claim 1 in which said drive means comprise threaded spindles.

12. Gilling or stretching apparatus comprising a plurality of individually movable pin bars, means for guiding said pin bars successively in a circuitous path comprising a linear stretching run, a linear return run in the opposite direction, and transverse runs connecting said stretching run and return run at each end, said stretching run and return run each having an entry end and an exit end, drive means for driving said pin bars along said circuitous path, at least one cylindrical cushioning member rotatably mounted at the entry end of said stretching run and positioned to be engaged by each pin bar as the latter travels from the exit end of said return run to the entry end of said stretching run, whereby to retard the motion of said pin bar, said cushioning member having a circumferential cushioning surface so disposed that the direction of travel of each pin bar at its point of engagement with said cushioning surface is at an acute angle to the tangent to said surface at said point of engagement, said cushioning member being provided with energy dissipating means comprising a partial filling of lead shot disposed in a hollow space within said cushioning member.

* * * * *